US011168265B2

(12) United States Patent
Morgan et al.

(10) Patent No.: US 11,168,265 B2
(45) Date of Patent: Nov. 9, 2021

(54) PROCESS OF REMOVING METAL CONTAMINANTS FROM LIGHT HYDROCARBONS

(71) Applicants: Waynn Morgan, Alvin, TX (US); Jerry Weers, Richmond, TX (US); James Kiolbassa, Mansfield, TX (US); Timothy O'Brien, Sugar Land, TX (US); Sai Reddy Pinappu, Sugar Land, TX (US); Tran minh Nguyen, Houston, TX (US)

(72) Inventors: Waynn Morgan, Alvin, TX (US); Jerry Weers, Richmond, TX (US); James Kiolbassa, Mansfield, TX (US); Timothy O'Brien, Sugar Land, TX (US); Sai Reddy Pinappu, Sugar Land, TX (US); Tran minh Nguyen, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 16/741,961

(22) Filed: Jan. 14, 2020

(65) Prior Publication Data

US 2021/0214621 A1 Jul. 15, 2021

(51) Int. Cl.

| | |
|---|---|
| ***C10G 19/02*** | (2006.01) |
| ***C10G 21/06*** | (2006.01) |
| ***C10G 29/06*** | (2006.01) |

(52) U.S. Cl.

CPC ..... *C10G 29/06* (2013.01); *C10G 2300/104* (2013.01); *C10G 2300/205* (2013.01)

(58) Field of Classification Search

CPC ..... C10G 19/02; C10G 21/06; C10G 29/06; B01J 2219/00006

See application file for complete search history.

(56) References Cited

U.S. PATENT DOCUMENTS

| | | | | |
|---|---|---|---|---|
| 4,915,818 | A * | 4/1990 | Yan | C10G 21/08 208/251 R |
| 6,537,443 | B1 * | 3/2003 | Frankiewicz | C10G 25/003 208/251 R |
| 2012/0121485 | A1 | 5/2012 | Rogers et al. | |
| 2016/0122659 | A1 | 5/2016 | Morgan et al. | |
| 2017/0037323 | A1 | 2/2017 | Abai et al. | |

FOREIGN PATENT DOCUMENTS

| | | | |
|---|---|---|---|
| CN | 110052243 | A | 7/2019 |
| WO | 9115559 | A2 | 10/1991 |

OTHER PUBLICATIONS

International Search Report for International Application No. PCT/US2021/013156, International Filing Date Jan. 13, 2021, dated Jul. 21, 2021, 3 pages.

Written Opinion for International Application No. PCT/US2021/013156, International Filing Date Jan. 13, 2021, dated Jul. 21, 2021, 4 pages.

* cited by examiner

*Primary Examiner* — Randy Boyer

(74) *Attorney, Agent, or Firm* — Cantor Colburn LLP

(57) ABSTRACT

A method of removing a metal contaminant from a light hydrocarbon stream comprises introducing a light hydrocarbon stream into a reactor vessel, the reactor vessel containing an aqueous treatment composition which comprises a treatment agent comprising one or more of the following: an alkali metal salt of a thiocarbonate; an alkaline earth metal salt of a thiocarbonate; an alkali metal salt of a tetrathioperoxy carbonate; or an alkaline earth metal salt of a tetrathioperoxy carbonate, the light hydrocarbon stream having an API gravity of greater than 28 degree determined in accordance with ASTM D 287-12 and comprising a metal contaminant; contacting the light hydrocarbon stream with the aqueous treatment composition generating a treated light hydrocarbon stream with a reduced level of the metal contaminant; and removing the treated light hydrocarbon stream from the reactor vessel.

20 Claims, 2 Drawing Sheets

PROCESS OF REMOVING METAL CONTAMINANTS FROM LIGHT HYDROCARBONS

BACKGROUND

Metals such as mercury occur naturally in the formations that comprise oil and gas. Depending on the region, crude oils may be contaminated with various concentrations of mercury. The removal of these metal contaminants allows for not only an upgrade in the crude oil, natural gas and fuel quality but benefits for a safe work environment. In an oil refinery, mercury is normally removed from hydrocarbon products using a mercury removal unit (MRU) that has beds filled with an adsorbent. However, mercury and other metals are a challenge for many light hydrocarbon streams containing $C_1$-$C_{30}$ hydrocarbons. Thus, processes that are effective to remove metals such as mercury from light hydrocarbons are continuously sought.

BRIEF DESCRIPTION

A method of removing a metal contaminant from a light hydrocarbon stream comprises introducing a light hydrocarbon stream into a reactor vessel, the reactor vessel containing an aqueous treatment composition which comprises a treatment agent comprising one or more of the following: an alkali metal salt of a thiocarbonate; an alkaline earth metal salt of a thiocarbonate; an alkali metal salt of a tetrathioperoxy carbonate; or an alkaline earth metal salt of a tetrathioperoxy carbonate, the light hydrocarbon stream having an API gravity of greater than 28 degree determined in accordance with ASTM D 287-12 and comprising a metal contaminant; contacting the light hydrocarbon stream with the aqueous treatment composition generating a treated light hydrocarbon stream with a reduced level of the metal contaminant; and removing the treated light hydrocarbon stream from the reactor vessel.

A system for removing a metal contaminant from a light hydrocarbon stream comprises a reactor vessel comprising an aqueous treatment composition comprising a treatment agent which includes one or more of the following: an alkali metal salt of a thiocarbonate; an alkaline earth metal salt of a thiocarbonate; an alkali metal salt of a tetrathioperoxy carbonate; or an alkaline earth metal salt of a tetrathioperoxy carbonate; one or more distribution manifolds for introducing the light hydrocarbon stream into the reactor vessel; a first outlet for removing a treated light hydrocarbon stream from the reactor vessel; and a second outlet for removing an aqueous based liquid enriched with metal contaminant or a derivative thereof from the reactor vessel.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
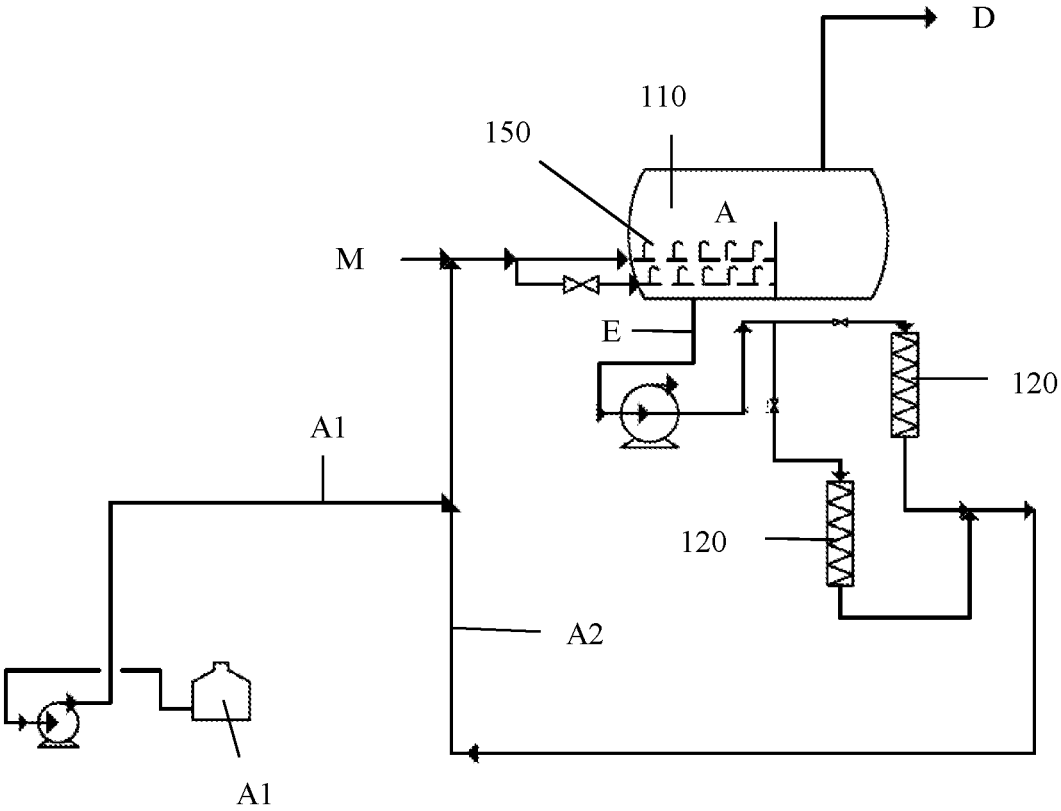
FIG. 1 illustrates a process of removing metal contaminants from a light hydrocarbon stream.

The inventors hereof have found an efficient process of removing or reducing metal contaminants such as mercury from light hydrocarbon streams for the oil and gas industry. The process involves the utilization of thiocarbonates and/or tetrathioperoxy carbonates of alkali metals and/or alkaline earth metals in an aqueous treatment composition, and is particularly effective to remove metal containments that are normally difficult to remove from light hydrocarbons.

As used herein, light hydrocarbons refer to hydrocarbons that have an American Petroleum Institute ("API") gravity greater than about 28 degree, preferably greater than about 50 degree, determined in accordance with American Society for Testing and Materials ("ASTM") D 287-12. Examples of light hydrocarbon streams include natural gas, methane, ethane, propane, butanes, pentanes, hexanes, carbon dioxide, liquefied petroleum gas ("LPG"), shale oils, jet oils, kerosene, and combinations thereof. In an embodiment, the light hydrocarbon stream is a gaseous stream. In addition to hydrocarbons, the gaseous stream can also contain asphyxiant gas components such as hydrogen sulfide, nitrogen, and carbon dioxide.

The light hydrocarbon stream can be separated upstream from the heavier hydrocarbons and production water via a separation mechanism such as a separator, distillation or any other means of separation. The light hydrocarbon is then passed through a particulate filter, if deemed necessary to remove at least some contaminants that may be in the stream and would negatively impact the operational efficiency of the process.

If the light hydrocarbon stream contains elemental mercury, the elemental mercury is converted to divalent mercury ions first before the light hydrocarbon stream is fed to a reactor vessel. Without wishing to be bound by theory, it is believed that elemental mercury is inert and can be difficult to remove with the treatment agent disclosed herein. By converting elemental mercury to divalent mercury ions, the reactivity of the mercury is greatly increased thus allowing the mercury to be effectively removed by the treatment agent disclosed herein in a reactor vessel.

Elemental mercury can be oxidized to divalent mercury ions by contacting an elemental mercury-containing light hydrocarbon with oxidants such as concentrated nitric acid, $HNO_3$, or concentrated sulfuric acid, perchloric acid, chloric acid, chromic acid, a number of organic acids, such as alkyl benzenesulfonic acids, and/or p-touluen sulfuric acid (tosylic acid), among others. Other known oxidants can also be used. As used herein, elemental mercury includes mercury alloy such as an amalgam. The light hydrocarbon stream introduced into a reactor vessel contains less than about 100 parts per trillion of elemental mercury.

In some embodiments, the light hydrocarbon can be obtained from a mixture comprising a gas, an oil, water, element mercury, and divalent mercury ions. Such a mixture can be treated with a sulfonic acid such an organic sulfonic acid or a derivative thereof. The organic sulfonic acids or a derivative thereof, in the presence of water can hydolyze and form the free sulfuric acid and organic constituent. The sulfuric acid can then react with the mercury to form the water soluble mercuric sulfate. Thus the treatment can force at least some of the mercury/mercury ions into an aqueous phase, which can be removed. The light hydrocarbon stream, if contains elemental mercury, can be treated as described herein to convert the elemental mercury to divalent mercury ions before fed into the reactor vessel.

The light hydrocarbon stream can be introduced into a reactor vessel, where the metal contaminates in the hydrocarbon stream are removed. The reactor vessel contains an aqueous treatment composition, one or more distribution manifolds for introducing the light hydrocarbon stream; a first outlet for removing a treated light hydrocarbon stream from the reactor vessel; and a second outlet for removing an aqueous based liquid enriched with metal contaminants derivatives thereof from the reactor vessel. The system ensures an adequate contact of the treatment composition with the light hydrocarbon stream being treated and reduces the total consumption of chemistry that may be required via a direct injection method. In addition, the precipitate that is formed can be timely removed thus reducing the downtime of the operation. The system can be either permanent or mobile and modular. A system designed like an API separator for the separation of the solids that are formed in the process can also be used.

The aqueous treatment composition in the reactor vessel contains a treatment agent, which includes an alkali metal salt of a thiocarbonate; an alkaline earth metal salt of a thiocarbonate; an alkali metal salt of a tetrathioperoxy carbonate; an alkaline earth metal salt of a tetrathioperoxy carbonate; or a combination comprising at least one of the foregoing. The treatment agent can be present in an amount of about 0.01 wt. % to about 5 wt. % based on the total weight of the aqueous treatment composition. When the amount of the treatment agent is less than about 5 wt. %, additional treatment agent can be added to the reactor vessel. In addition to the treatment agent, the aqueous treatment composition further contains water. In an embodiment, the aqueous treatment composition is an aqueous solution of the treatment agent.

The aqueous treatment composition can be fed into the reactor vessel before the light hydrocarbon stream is introduced. Alternatively, the aqueous treatment composition and the light hydrocarbon stream can be introduced into a reactor vessel at the same time. In an embodiment, a fresh or recycled aqueous treatment composition is fed into the reactor vessel together with the light hydrocarbon stream via the distribution manifolds. Fresh or recycled aqueous treatment composition can also be fed into the reactor vessel via a circulation line instead of the distribution manifolds. Additional treatment composition can be introduced to maintain reactive chemistry within the reactor vessel.

In the reactor vessel, the light hydrocarbon stream contacts and intermingles with the aqueous treatment composition. The design on the reactor will be system dependent and will not be limited by temperature or pressure. The residence time of the light hydrocarbon stream in the reactor vessel is typically dependent on the operating conditions and discharge requirements of the treated stream.

After the contacting and the intermingling, a phase separation occurs within the reactor vessel. The heavy aqueous phase contains metal contaminants or derivatives thereof. The light hydrocarbon phase contains the treated light hydrocarbon. The process is particularly useful for removing metal contaminants such as divalent mercury ions, arsenic; cadmium; berrium; iron; or a combination comprising at least one of the foregoing. In an embodiment, the light hydrocarbon stream comprises greater than 1 part per million of divalent mercury ions; and the treated hydrocarbon stream comprises less than 100 parts per trillion of divalent mercury ions or less than 50 parts per trillion of divalent mercury ions.

The treated hydrocarbon, which has a reduced level of metal contamination, is removed from the reactor vessel via the first outlet, which can be located on the top part of the reactor vessel. If deemed necessary due to water or chemical carryover from the reactor vessel, a coalesce/separator and/or molecular sieve or other means of drying or purifying the treated light hydrocarbon stream may be utilized downstream from the reactor vessel in order to meet additional product specifications.

The aqeuous phase enriched with metal contaminants or derivatives thereof can be removed from the reactor vessel via the second outlet, which is normally located at the bottom part of the reactor vessel. The removed aqueous phase can be filtered, centrifuged, or treated with other means known to a person skilled in the art to separate out the solids or the precipitates in the aqueous phase. The treated aqueous phase can be recycled and returned to the reactor vessel.

Figure 2:
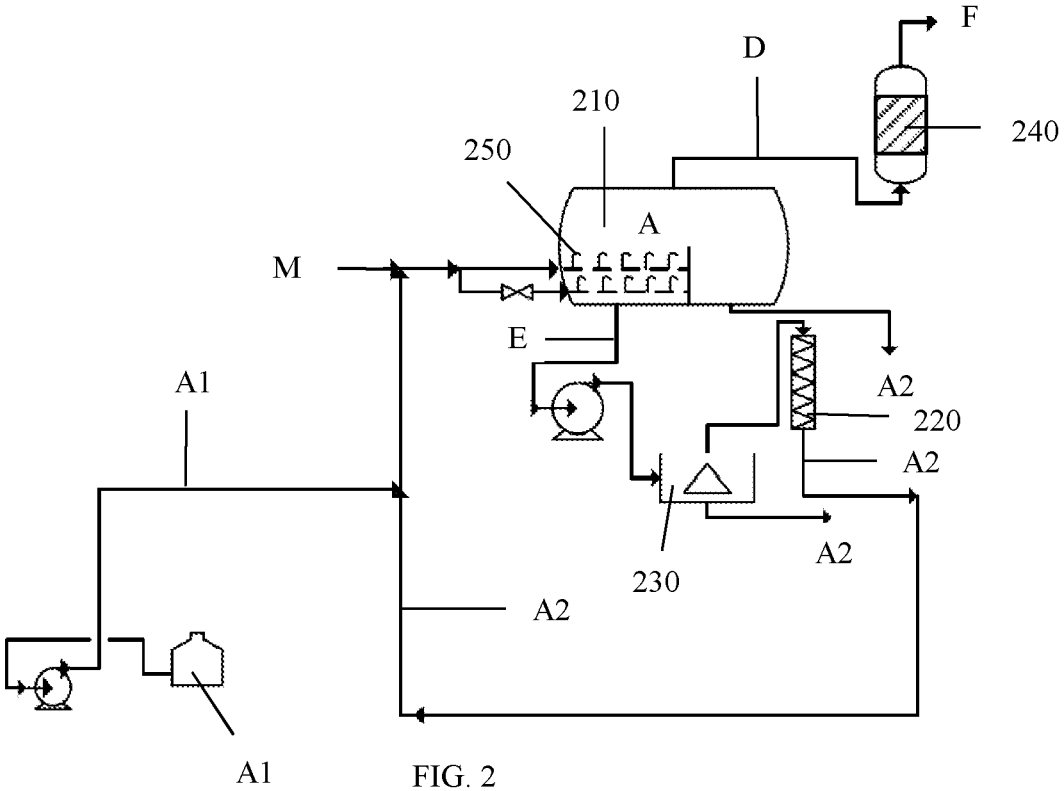
FIG. 2 illustrates another process of removing metal contaminants from a light hydrocarbon stream.
Figure 3:
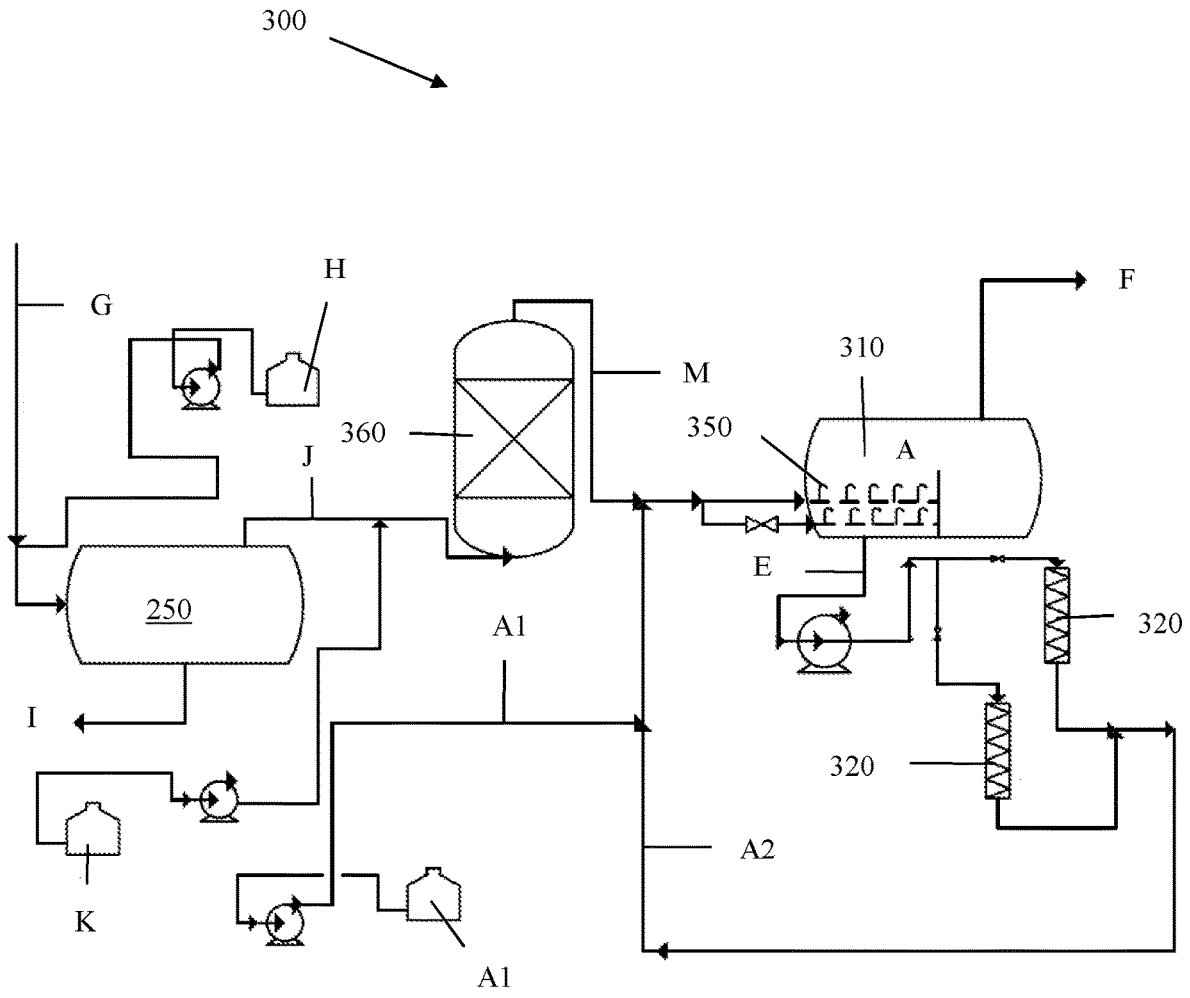
FIG. 3 is a simplified scheme illustrating a process of removing metal contaminants from an oil/gas/water mixture.

Referring to FIGS. 1-3, a light hydrocarbon stream M is introduced into a reactor vessel (110, 210, 310) via distribution manifolds (150, 250, 350). The reactor vessel contains an aqueous treatment composition A. After the light hydrocarbon stream M is intermingled and contacted with treatment composition A in the reactor vessel, at least two phases are generated. The oil and/or gaseous phase, which has reduced metal contamination, is removed as treated light hydrocarbon stream D. If necessary, the treated light hydrocarbon stream D can be passed through molecular sieves 240 to provide further dried light hydrocarbon stream F. The aqueous phase, which contains precipitates of metal contaminants or derivatives thereof, are drawn as stream E from the reactor vessel. The contaminated aqueous phase E can be treated with a filter (120, 220, 320) or a centrifuge (230) to provide a recycled aqueous treatment composition (A2) that are substantially free of precipitates. Fresh treatment composition A1 and/or recycled treatment composition A2 can be added to the reactor vessel during the process as needed.

FIG. 3 is a simplified scheme illustrating a process (300) of removing metal contamination from an oil/gas/water mixture (G) that contains elemental mercury, divalent mercury ions, and optionally other metal contaminants. Mixture G is introduced into a separator (250) where the mixture (G) is intermingled with a sulfonic acid such as an organic sulfonic acid or a derivative thereof (H) to generate a liquid phase (I) and a gaseous hydrocarbon phase (J). The liquid phase (I) contains oil, water, and divalent mercury ions or derivatives thereof. The gaseous phase (J), which contains elemental mercury, is introduced into an acidifier (360), where elemental mercury in the hydrocarbon stream is converted to mercury ions by reacting the elemental mercury with oxidants (K). The mercury ion-containing stream (M) can be treated with treatment composition (A1, A2) as described herein.

Set forth below are various embodiments of the disclosure.

Embodiment 1. A method of removing a metal contaminant from a light hydrocarbon stream, the method comprising: introducing a light hydrocarbon stream into a reactor vessel, the reactor vessel containing an aqueous treatment composition which comprises a treatment agent comprising one or more of the following: an alkali metal salt of a thiocarbonate; an alkaline earth metal salt of a thiocarbonate; an alkali metal salt of a tetrathioperoxy carbonate; or an alkaline earth metal salt of a tetrathioperoxy carbonate, the light hydrocarbon stream having an API gravity of greater than 28 degree determined in accordance with ASTM D 287-12 and comprising a metal contaminant; contacting the light hydrocarbon stream with the aqueous treatment composition generating a treated light hydrocarbon stream with a reduced level of the metal contaminant; and removing the treated light hydrocarbon stream from the reactor vessel.

Embodiment 2. The method of any one of the preceding embodiments, wherein the light hydrocarbon stream has an API gravity of greater than 50 degree determined in accordance with ASTM D 287-12.

Embodiment 3. The method of any one of the preceding embodiments, wherein the light hydrocarbon stream is a gaseous stream.

Embodiment 4. The method of any one of the preceding embodiments, wherein the light hydrocarbon stream is introduced into the reactor vessel via a distribution manifold.

Embodiment 5. The method of any one of the preceding embodiments, wherein the treatment agent is present in an amount of about 0.01 ppm to about 5 wt. % based on the total weight of the aqueous treatment composition.

Embodiment 6. The method of any one of the preceding embodiments, wherein the metal contaminant comprises one or more of the following: divalent mercury ions; arsenic; cadmium; berrium; or iron.

Embodiment 7. The method of any one of the preceding embodiments, wherein the light hydrocarbon stream comprises greater than 1 parts per million of divalent mercury ions, and the treated light hydrocarbon stream comprises less than 100 parts per trillion of divalent mercury ions.

Embodiment 8. The method of any one of the preceding embodiments further comprising filtering the treated light hydrocarbon stream, drying the treated light hydrocarbon stream, or a combination thereof.

Embodiment 9. The method of any one of the preceding embodiments further comprising removing an aqueous based liquid enriched with the metal contaminant or a derivative thereof from the reactor vessel.

Embodiment 10. The method of Embodiment 9 further comprising filtering the removed aqueous based liquid; and returning the filtered aqueous based liquid to the reactor vessel.

Embodiment 11. The method of Embodiment 9 further comprising centrifuging the removed aqueous based liquid.

Embodiment 12. The method of any one of the preceding embodiments further comprising adding additional aqueous treatment composition to the reactor vessel.

Embodiment 13. The method of any one of the preceding embodiments further comprising converting elemental mercury in an elemental mercury-containing light hydrocarbon stream to divalent mercury ions to provide the light hydrocarbon before introducing the light hydrocarbon stream into the reactor vessel.

Embodiment 14. The method of Embodiment 13, wherein elemental mercury is converted to divalent mercury ions by contacting the elemental mercury-containing light hydrocarbon stream with one or more of the following: nitric acid; concentrated sulfuric acid; perchloric acid; chloric acid; or chromic acid.

Embodiment 15. The method of Embodiment 13 further comprising contacting a mixture of oil, gas, water, elemental mercury, and divalent mercury ions with a sulfonic acid derivative in a separator to generate an aqueous phase and a hydrocarbon phase, and removing the hydrocarbon phase from the separator to provide the elemental mercury-containing light hydrocarbon stream.

Embodiment 16. A system for removing a metal contaminant from a light hydrocarbon stream, the system comprising: a reactor vessel comprising an aqueous treatment composition comprising a treatment agent which includes one or more of the following: an alkali metal salt of a thiocarbonate; an alkaline earth metal salt of a thiocarbonate; an alkali metal salt of a tetrathioperoxy carbonate; or an alkaline earth metal salt of a tetrathioperoxy carbonate; one or more distribution manifolds for introducing the light hydrocarbon stream into the reactor vessel; a first outlet for removing a treated light hydrocarbon stream from the reactor vessel; and a second outlet for removing an aqueous based liquid enriched with metal contaminant or a derivative thereof from the reactor vessel.

All ranges disclosed herein are inclusive of the endpoints, and the endpoints are independently combinable with each other. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." The modifier "about" used in connection with a quantity is inclusive of the stated value and has the meaning dictated by the context (e.g., it includes the degree of error associated with measurement of the particular quantity).

What is claimed is:

1. A method of removing a metal contaminant from a light hydrocarbon stream, the method comprising:

introducing a light hydrocarbon stream into a reactor vessel, the reactor vessel containing an aqueous treatment composition which comprises a treatment agent comprising one or more of the following: an alkali metal salt of a thiocarbonate; an alkaline earth metal salt of a thiocarbonate; an alkali metal salt of a tetrathioperoxy carbonate; or an alkaline earth metal salt of a tetrathioperoxy carbonate, the light hydrocarbon stream having an API gravity of greater than 28 degrees determined in accordance with ASTM D 287-12 and comprising a metal contaminant;

contacting the light hydrocarbon stream with the aqueous treatment composition generating a treated light hydrocarbon stream with a reduced level of the metal contaminant, and removing the treated light hydrocarbon stream from the reactor vessel, wherein the method further comprises converting elemental mercury in an elemental mercury-containing light hydrocarbon stream to divalent mercury ions to provide the light hydrocarbon stream before introducing the light hydrocarbon stream into the reactor vessel.

2. The method of claim 1, wherein the light hydrocarbon stream has an API gravity of greater than 50 degrees determined in accordance with ASTM D 287-12.

3. The method of claim 1, wherein the light hydrocarbon stream comprises a gas.

4. The method of claim 1, wherein the light hydrocarbon stream is introduced into the reactor vessel via a distribution manifold.

5. The method of claim 1, wherein the treatment agent is present in an amount of about 0.01 ppm to about 5 wt. % based on the total weight of the aqueous treatment composition.

6. The method of claim 1, wherein the metal contaminant comprises one or more of the following: divalent mercury ions; arsenic; cadmium; berrium; or iron.

7. The method of claim 1, wherein the light hydrocarbon stream comprises greater than 1 parts per million of divalent mercury ions, and the treated light hydrocarbon stream comprises less than 100 parts per trillion of divalent mercury ions.

8. The method of claim 1 further comprising filtering the treated light hydrocarbon stream, drying the treated light hydrocarbon stream, or a combination thereof.

9. The method of claim 1 further comprising removing an aqueous based liquid enriched with the metal contaminant or a derivative thereof from the reactor vessel.

10. The method of claim 9 further comprising filtering the removed aqueous based liquid; and returning the filtered aqueous based liquid to the reactor vessel.

11. The method of claim 9 further comprising centrifuging the removed aqueous based liquid.

12. The method of claim 1 further comprising adding additional aqueous treatment composition to the reactor vessel.

13. The method of claim 1, wherein elemental mercury is converted to divalent mercury ions by contacting the elemental mercury-containing light hydrocarbon stream with one or more of the following: nitric acid; concentrated sulfuric acid; perchloric acid; chloric acid; or chromic acid.

14. The method of claim 1 further comprising contacting a mixture of oil, gas, water, elemental mercury, and divalent mercury ions with a sulfonic acid derivative in a separator to generate an aqueous phase and a hydrocarbon phase, and removing the hydrocarbon phase from the separator to provide the elemental mercury-containing light hydrocarbon stream.

15. A system for removing a metal contaminant from a light hydrocarbon stream, the system comprising:

an acidifier comprising an oxidant wherein elemental mercury in an elemental mercury-containing light hydrocarbon stream is converted to mercury ions by reacting the elemental mercury with the oxidant to provide the light hydrocarbon stream;

a reactor vessel coupled to the acidifier, the reactor vessel comprising an aqueous treatment composition comprising a treatment agent which includes one or more of the following: an alkali metal salt of a thiocarbonate; an alkali alkaline earth metal salt of a thiocarbonate; an alkali metal salt of a tetrathioperoxy carbonate; or an alkaline earth metal salt of a tetrathioperoxy carbonate;

one or more distribution manifolds for introducing the light hydrocarbon stream into the reactor vessel;

a first outlet for removing a treated light hydrocarbon stream from the reactor vessel; and a second outlet for removing an aqueous based liquid enriched with metal contaminant or a derivative thereof from the reactor vessel.

16. A system for removing a metal contaminant from a light hydrocarbon stream, the system comprising:

a reactor vessel comprising an aqueous treatment composition comprising a treatment agent which includes one or more of the following: an alkali metal salt of a tetrathioperoxy carbonate; or an alkaline earth metal salt of a tetrathioperoxy carbonate;

one or more distribution manifolds for introducing the light hydrocarbon stream into the reactor vessel;

a first outlet for removing a treated light hydrocarbon stream from the reactor vessel; and a second outlet for removing an aqueous based liquid enriched with metal contaminant or a derivative thereof from the reactor vessel.

17. A method of removing a metal contaminant from a light hydrocarbon stream, the method comprising:

introducing a light hydrocarbon stream into a reactor vessel, the reactor vessel containing an aqueous treatment composition which comprises a treatment agent comprising at least one or more of the following: an alkali metal salt of a tetrathioperoxy carbonate; or an alkaline earth metal salt of a tetrathioperoxy carbonate, the light hydrocarbon stream having an API gravity of greater than 28 degrees determined in accordance with ASTM D 287-12 and comprising a metal contaminant, contacting the light hydrocarbon stream with the aqueous treatment composition generating a treated light hydrocarbon stream with a reduced level of the metal contaminant, and removing the treated light hydrocarbon stream from the reactor vessel.

18. The method of claim 17 further comprising converting elemental mercury in an elemental mercury-containing light hydrocarbon stream to divalent mercury ions to provide the light hydrocarbon before introducing the light hydrocarbon stream into the reactor vessel.

19. The method of claim 18, wherein elemental mercury is converted to divalent mercury ions by contacting the elemental mercury-containing light hydrocarbon stream with one or more of the following: nitric acid; concentrated sulfuric acid; perchloric acid; chloric acid; or chromic acid.

20. The method of claim 18 further comprising contacting a mixture of oil, gas, water, elemental mercury, and divalent mercury ions with a sulfonic acid derivative in a separator to generate an aqueous phase and a hydrocarbon phase, and removing the hydrocarbon phase from the separator to provide the elemental mercury-containing light hydrocarbon stream.

* * * * *